United States Patent [19]

Lee

[11] Patent Number: 4,648,481

[45] Date of Patent: Mar. 10, 1987

[54] MULTIPURPOSE ALUMINUM FOLDING LADDER EQUIPPED WITH A DETACHABLE STAND-ON BOARD AND SUPPORTING HANDRAILS

[75] Inventor: Dickey Lee, Taipei, Taiwan

[73] Assignee: Alpha Metal Corp., Taipei, Taiwan

[21] Appl. No.: 858,523

[22] Filed: Apr. 21, 1986

[51] Int. Cl.[4] ..... E06C 5/44; E06C 1/38; E06C 5/36; A63B 21/06

[52] U.S. Cl. ..... 182/28; 182/33; 182/35; 182/106; 182/118; 272/900

[58] Field of Search ..... 182/20, 21, 27, 28, 182/33, 35, 163, 106, 118; 272/144, 900

[56] References Cited

U.S. PATENT DOCUMENTS

| | | | |
|---|---|---|---|
| D. 161,091 | 12/1950 | Cramer | 182/106 |
| 2,907,402 | 10/1959 | Lewis | 182/106 |
| 3,289,787 | 12/1966 | McSwain | 182/20 |
| 3,554,318 | 1/1971 | Knight | 182/27 |
| 3,613,831 | 10/1971 | Estep | 182/27 |
| 4,262,902 | 4/1981 | Dranselka | 272/900 |
| 4,293,055 | 10/1981 | Hooser | 182/106 |
| 4,295,544 | 10/1981 | Peterson | 182/106 |
| 4,303,145 | 12/1981 | Vazquez | 182/106 |
| 4,425,984 | 1/1984 | Lachance | 182/106 |

*Primary Examiner*—Reinaldo P. Machado
*Attorney, Agent, or Firm*—Browdy and Neimark

[57] ABSTRACT

The present disclosure is related to a multi-purpose aluminum folding ladder having a detachable stand-on board and a pair of supporting handrails mounted thereto when used as a stepladder, and more particular to a foldable ladder which can be converted into ladders of different forms such as, a stepladder, a stretched climbing ladder, and also into work stations, and tables etc., and can further be assembled into a variety of exercising apparatuses with the assistance of a number of accessory parts on which people can do various kinds of exercise such as rowing, weight-pulling, chest-expanding, arm and leg strengthening; and can also be transformed into a chair for relaxation purpose. The multipurpose folding ladder is characterized by its practicality and readiness in use.

6 Claims, 28 Drawing Figures

MULTIPURPOSE ALUMINUM FOLDING LADDER EQUIPPED WITH A DETACHABLE STAND-ON BOARD AND SUPPORTING HANDRAILS

SUMMARY OF THE INVENTION

The present invention is concerned with a multi-purpose aluminum folding ladder which can be detachably equipped with supporting handrails for safety purpose and a stand-on board at the top thereof for convenience purpose, and consists of a number of ladder sections joined together by a number of paired fixing knuckles, specially designed for easy and safe operation and adjustably operated at a number of stages, so to readily change the fixing angle of the folding ladder for converting the folding ladder into different forms of ladders, work stations and table facilities. The aluminum folding ladder can further be assembled into different types of exercise devices in combination with a plurality of accessory parts, permitting users of the equippment to do multiple types of exercise thereon.

In consideration of operation safety, the folding ladder of the conventional design is not permitted to stand thereon by users to prevent accidents from happening owing to the users losing their balance on the ladder.

In the practical use of the stepladders, most users will neglect the safety requirements and stand on the top thereof for the purpose of operational convenience. The climbing up and down the stepladder can often cause accidents when nothing can be grasped or held to support the users.

The inventor viewing the disadvantges associated with the conventional stepladder, is dovoted to providing a foldable ladder which can be removably equipped with a stand-on board and a pair of supporting handrails for improving the operation safety of the ladder.

The primary object of the present invention is to provide an aluminum folding ladder which is detachably equipped with extended supporting handrails and a stand-on board at the top for people to safely stay on the top thereof with hands holding said handrails when the foldable ladder is used as a stepladder.

The secondary object of the present invention is to provide an aluminum folding ladder which can be transformed into a relaxation chair with the assistance of a number of sitting pads, and further into an exercise chair in cooperation with a plurality of accessory parts so to enable people to do various kinds of exercise thereon for body-building purpose.

The further object of the present invention is to provide an aluminum folding ladder which can be readily converted into ladders of various kinds, tables and working stations for multiple-purpose use.

By way of the accompaning drawings, the structure, function and features of the present invention can be further understood, in which.

DETAILED DESCRIPTION

Figure 1:
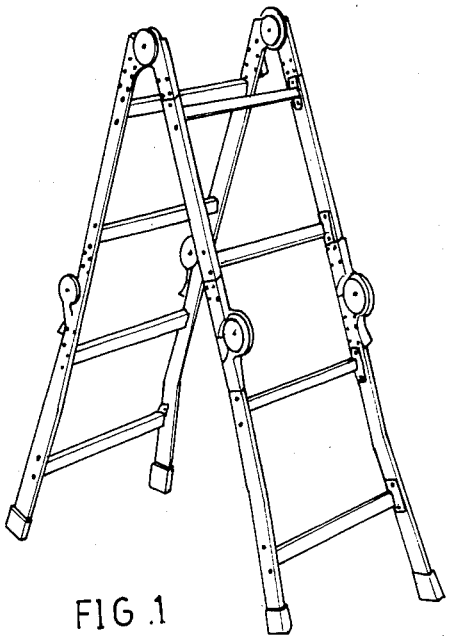
FIG. 1 is a view showing the present disclosure converted into a stepladder.
Figure 2:
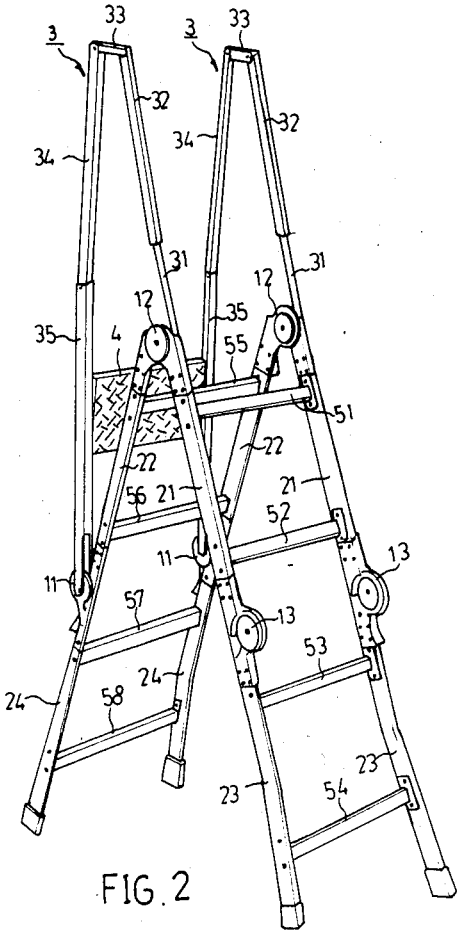
FIG. 2 is a view in which the folding ladder is transformed into a stepladder with the extended supporting handrail and the stand-on platform.
Figure 4:
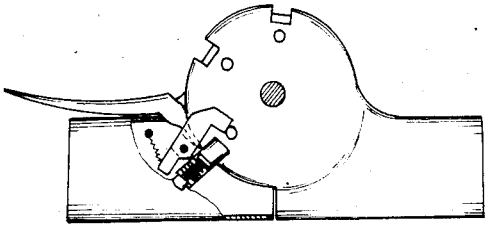
FIG. 4 is an assembled view of the fixing knuckle.
Figure 3:
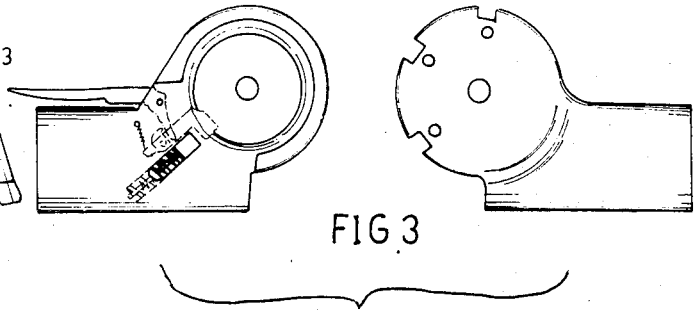
FIG. 3 is an exploded view of one of the fixing knuckles which are used to join the ladder sections together and lock the ladder in different fixed positions.
Figure 6:
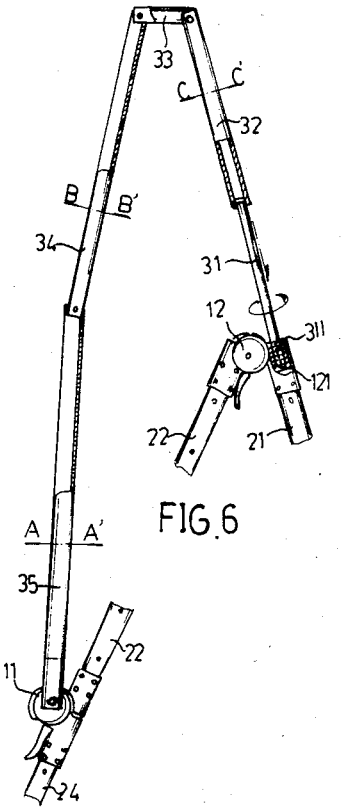
FIG. 6 is a view illustrating the way the extended supporting handrails attached to the ladder.

First refer to FIG. 2 in which a perspective view of the aluminum folding ladder in a stepladder form is shown with the accessory supporting handrails and stand-on board not fully mounted thereon. There are three pairs of fixing knuckles 11, 12, 13, which join the ladder sections together in which fixing knuckle 11 is adjustable in 3 stages, i.e.; from 0° to 60°, to 105°, and to 180° respectively; and fixing knuckle 12 is adjustable in 4 stages, i.e.; from 0° to 45°, to 105°, to 135°, to 180° respectively; and the fixing knuckle 13 is also adjustable in 4 stages, i.e.; from 0° to 60°, to 105°, to 135°, to 180° respectively. The said fixing knuckles are different from the conventional ones used in the prior art and structured in a better way for easy operation and longer durability, in accordance with the U.S. ladder safety criterion. The patent application has been filed for the specific fixing knuckle in U.S.A., titled "Impovement of the fixing knuckle in a foldable aluminum ladder", which is clearly shown in FIGS. 3 and 4.

The assembled stepladder as shown in FIG. 2 is comprised of three pairs of fixing knuckles 11, 12, 13 and two pairs of lower upright bars 23, 24, two pairs of upper upright bars 21, 22, a pair of extended supporting handrails 3, and a stand-on board 4. Lower upright bars 23, 24 and upper upright bars 21,22 are slightly differently structured with the former, which stands on the floor and supports the weight of the ladder and the whole object thereon, strengthened by increasing the dimensions of their legs, the latter equally dimensioned. (from top to bottom)

Figure 5:
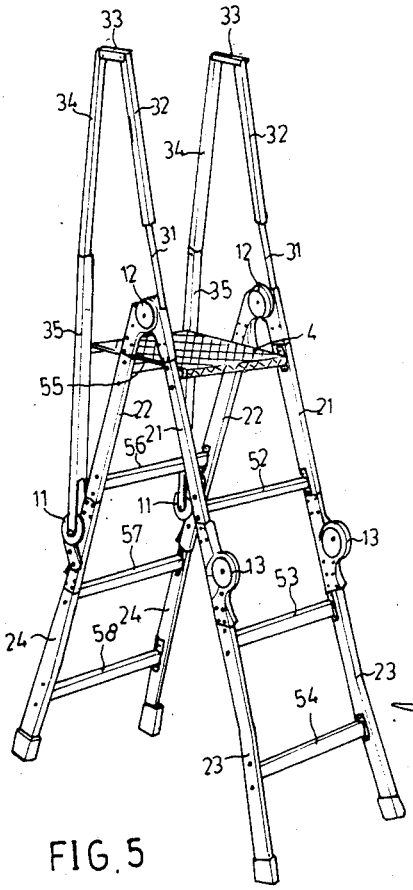
FIG. 5 is a view showing the stand-on board being mounted on the ladder.
Figure 7:
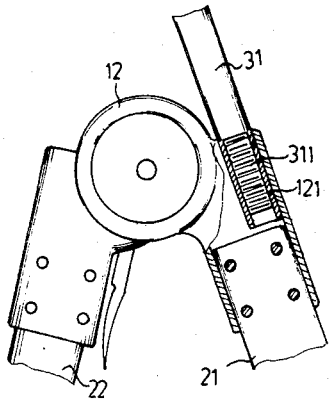
FIG. 7 is an enlarged view of the fixing knuckle handrail coupled with a joining bar member of the supporting.
Figure 11:
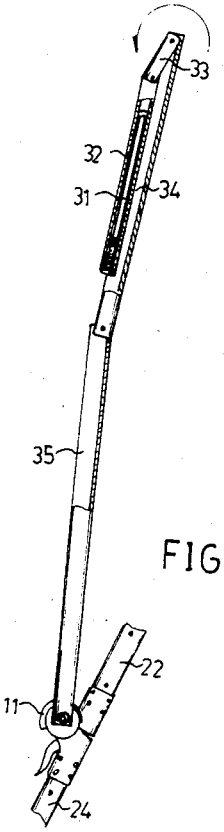
FIG. 11 is a partially sectional view of the extended supporting handrail showing the first connecting bar member received within the second bar member thereof and the handrail being in a folded state.
Figure 8:
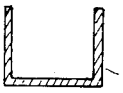
FIG. 8 is a sectional view of the second U-shaped bar member of the supporting handrail.
Figure 9:
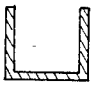
FIG. 9 is a sectional view of the third U-shaped bar member of the supporting handrail.
Figure 10:
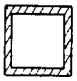
FIG. 10 is a sectional view of the first connecting bar member of the supporting handrail.
Figure 12:
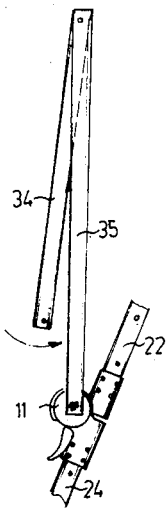
FIG. 12 is a view to demonstrate the way the supporting handrail being further folded.
Figure 13:
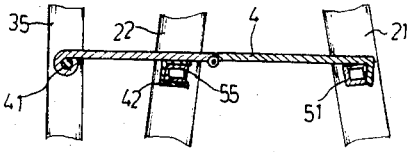
FIG. 13 is a sectional view showing how the stand-on platform is mounted on the top of the ladder.
Figure 14:
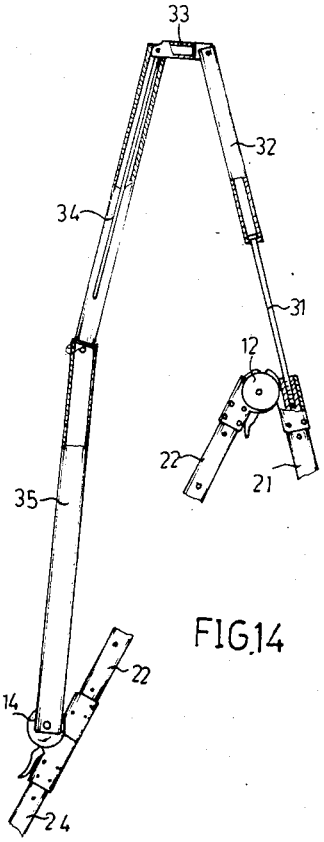
FIG. 14 is an enlarged view showing the way in which the supporting handrail is detachably mounted on the ladder.

As shown in FIG. 5, the stepladder is completely assembled with the extended supporting handrails 3 moounted thereon and the stand-on board 4 disposed at the top thereof. Said supporting handrails 3 consist of 5 tubular members 31, 32, 33, 34, 35, i.e., a rod 31, 2 holding sticks 32, 34, a bottom stick 35 and a grip bar 33, with bar 31 having a threaded end 311 extendably received in said tubular holding stick 32 and joined to the threaded tube 121 of the fixing knuckle 12. Tubular holding sticks 32, 34 are pivotably joined to the respective end by pins of the grip bar 33. Also sticks 34 and 35 are pivotably joined by pins together, and the respective cross sections of said tubular sticks 32, 34, 35 are shown in FIGS. 8,9,10. The bottom end of said tubular stick 35 having two parallely extended sides is secured to said fixing knuckle 11 by bolts, permitting said stick 35 to make a 180° rotation. The folding process of said supporting handrail 3 is illustrated in FIGS. 11, 12. Moreover, a foldable stand-on board 4 is attached to a transverse rung disposed between the pair of tubular sticks 35 of said supporting handrails 3 and can be placed on the two topmost transverse rungs 51, 55 of said ladder for standing-on purpose when fully extended, and be firmly fixed to said rungs by means of two hook-like elements 42 thereunder as shown in FIG. 13. The mounting and dismounting of said handrails 3 as well as said stand-on board 4 on said stepladder can be carried out with readiness in short time. In FIG. 14, another type of supporting handrail is shown, which consists of a number of tubular members of different sizes so that they can be packed with the samller tubular members extendably accommodated in the larger ones in a consecutive order, the structure of the tubular members are similar to the tubular member 31 which can be received in the member 32 as shown in FIG. 11 and FIG. 12 and pulled out for attachment in assembly by securing the first tubular member having a threaded end to a correspondingly threaded hole as shown in FIG. 7 and the other end of the supporting handrail to a fixing knuckle by bolts.

Figure 18:
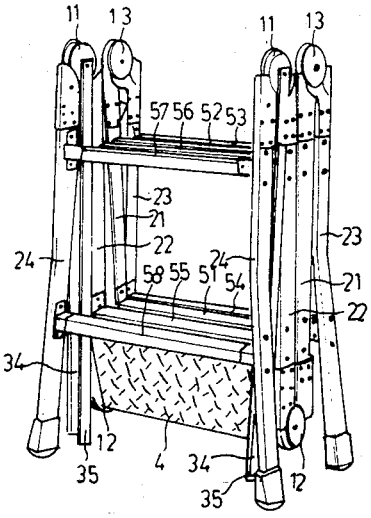
FIG. 18 is a diagram showing the folding ladder folded and packed together.
Figure 15:
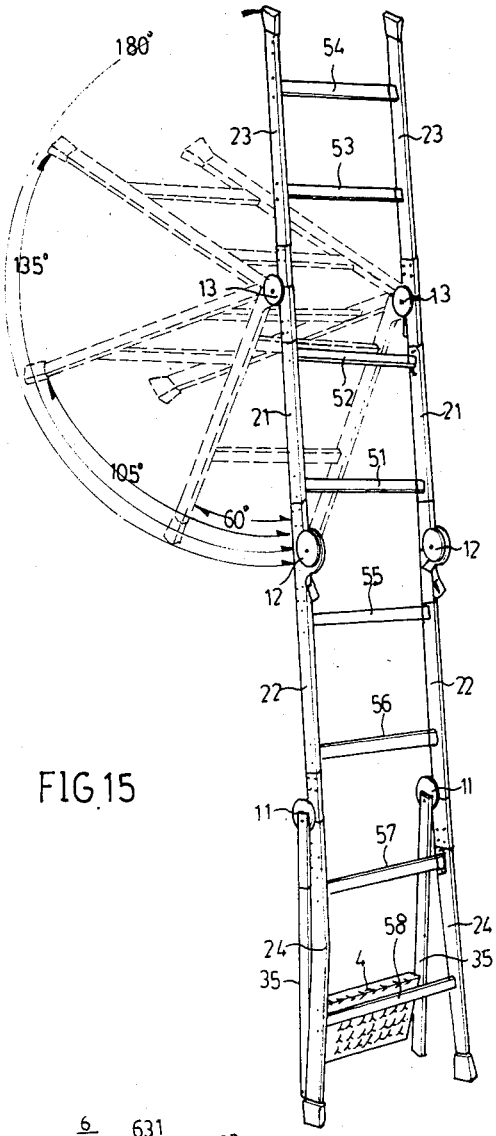
FIG. 15 is a view illustrating the top section of the folding ladder being put in 4 different stages indicated by the different angles.
Figure 16:
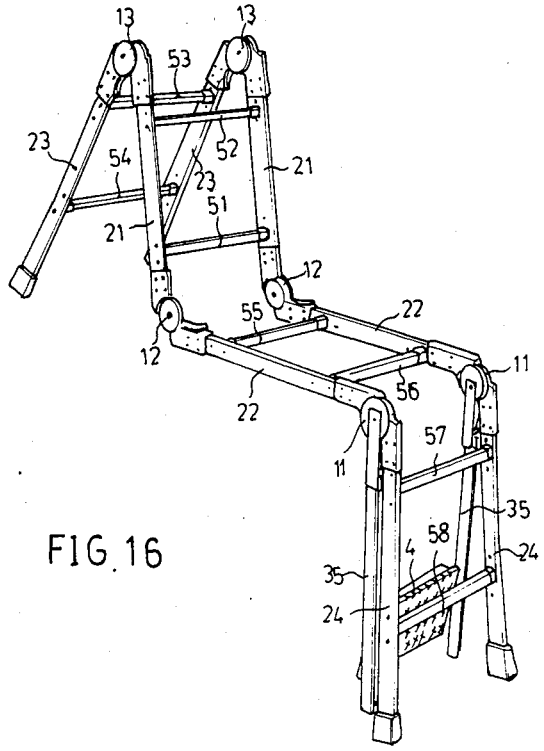
FIG. 16 is a diagram showing the ladder folded into a frame structure for use.
Figure 17:
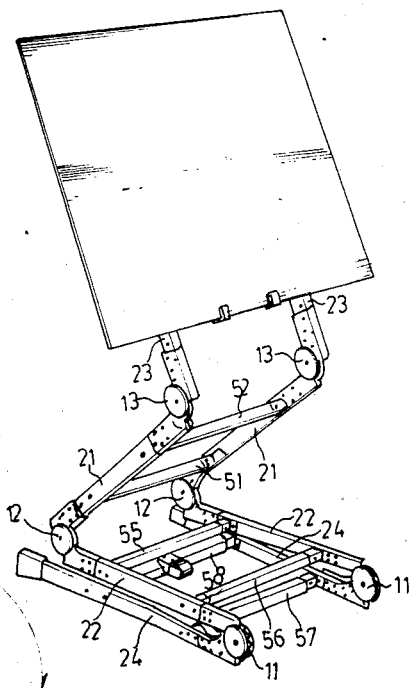
FIG. 17 is a diagram showing the ladder converted into an easel.

Continuing to refer to FIG. 15, the present invention can be changed into a straight climbing ladder, the ladder section consisting of two uprights 23 is rotated into a collinear relationship with the rest of ladder sections by way of said fixing knuckle 13, and it can be obviously seen that the folded stand-on board and the supporting handrails will not hinder the operation of the conversions of the ladder at all, and this forming one of the primary characteristics thereof, with the board 4 disposed at the bottom of said stretched ladder and in a position lower than the bottommost rung 58 and placed between the lower uprights thereof so that the user can step on the last rung 58 without inconvenience. The fixing knuckles 11 and 12 can be adjusted in cooperation with each other at different stages so that said ladder can be readily converted into various kinds of frame and ladder according to practical needs as shown in FIG. 16, shaped in A, C, M and L forms for multi-purpose use. Moreover, the ladder can also be transformed into a table and an easel as shown in FIG. 17, and compactly folded as shown in FIG. 18 for easy transport.

Figure 19:
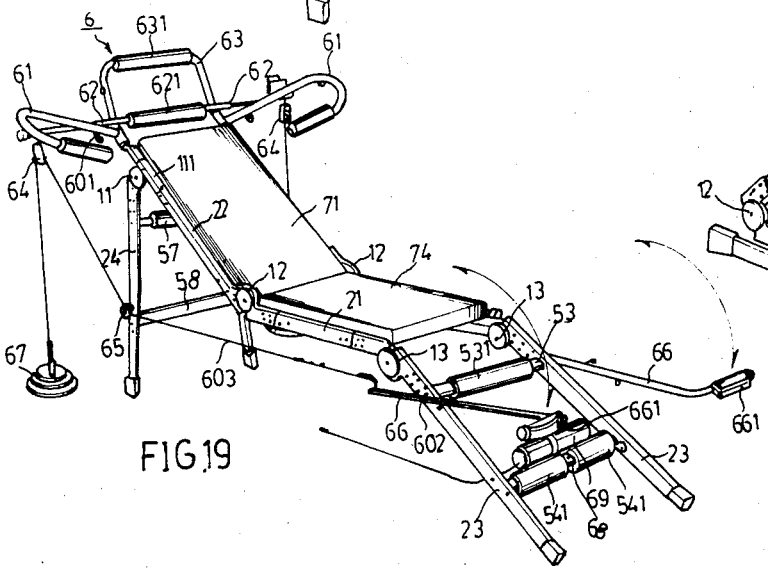
FIG. 19 is a diagram showing the ladder converted into a multi-purpose exercise apparatus.

Continuing now to refer to FIG. 19, the folding ladder is changed into an exercise apparatus with a lie-down bench; this change is started with removing said supporting handrails as well as said stand-on board from the ladder; the supporting handrails being removably fixed to said fixing knuckles by bolts and nuts, so can be detached therefrom readily; a symmetric frame 6 consisting of a pair of chest-expanding bar members 61, a horizontal bar member 62, a C-shaped top bar member 63, is removably attached to said fixing knucks 11 by inserting the ends of C-shaped top bar members 63 into the tubular members of said fixing knuckles, and at both ends of said horizontal bar member 62 are attached with a hanging pulley 64 respectively, and a pair of pulley 65 placed at both sides of said upright bar members 24, and a pair of oar members 66 is fixed to both sides of the ladder upright bar members 23 by way of pins 602, which are connected to a set of adjustable counterweights through cable 64 led through said cable pulleys 64, 65, permitting people to do both the rowing and leg strengthening exercises theron.

Figure 20:
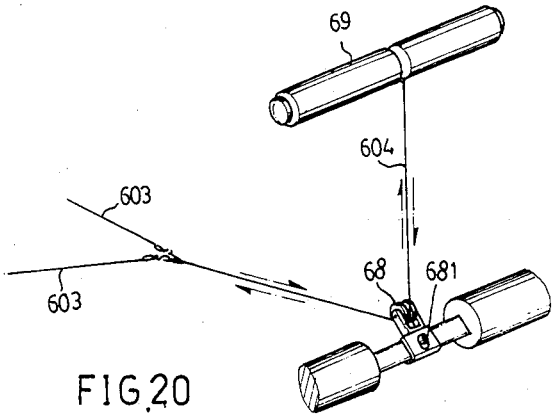
FIG. 20 is a view showing the cables led through a pulley and attached to a bar member.

Furthermore, as shown in FIG. 20, to the transverse rung 54 of the ladder, at the middle thereof, is secured a cable 68 by way of a pulley which is fixed in position by a pin 681, and cable 604 is mounted thereon and connected to two splited cables 603 at one end thereof, and at the other end connected a lift bar 69 for exercising muscles of either arms or legs.

Figure 21:
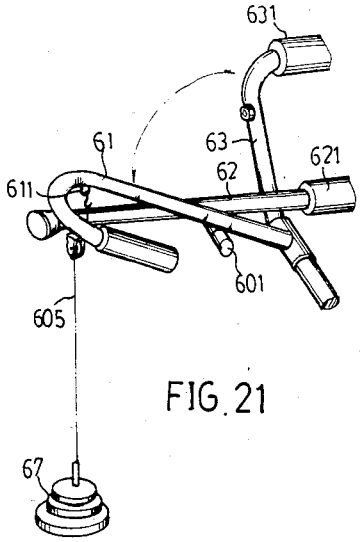
FIG. 21 is a partially enlarged view of the chest-expanding bar member disposed in relation with a horizontal bar member.

In FIG. 21, chest-expanding bar members 61 having hooks 611 thereon are cupled to counterweight 67 through cable 605 which is hooked to said hook 611 at one end thereof; By way of repeated lift and lowering of said members 61 people can exercise the muscles of their chests. Horizontal bar members 62 is disposed in the position to stop said chest-expanding members 61 from moving over the horizontal bar member 62.

Figure 22:
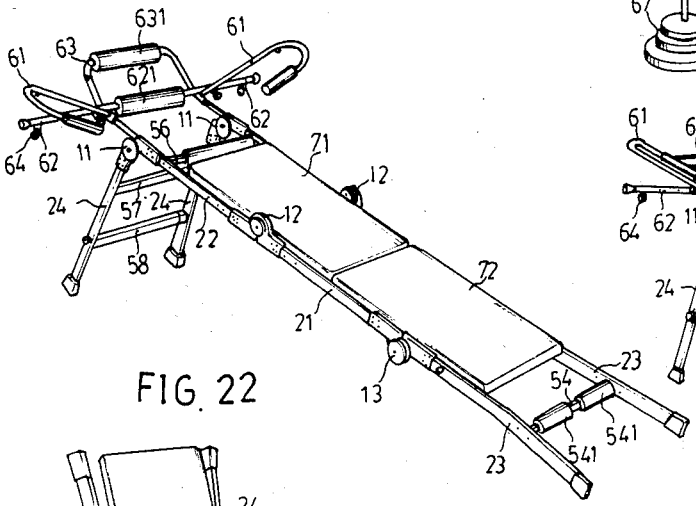
FIG. 22 is a view showing the ladder transformed into an exercise chair on which one can do sit-up exercise.
Figure 23:
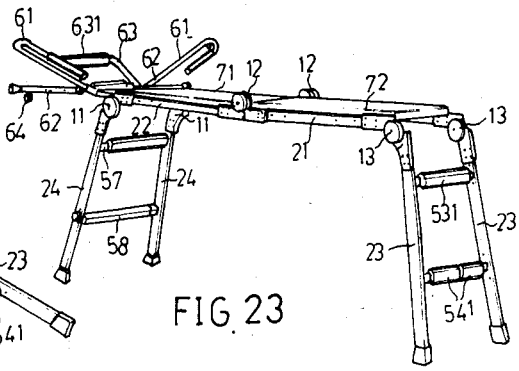
FIG. 23 is a view showing the ladder transformed into another type of exercise chair.
Figure 24:
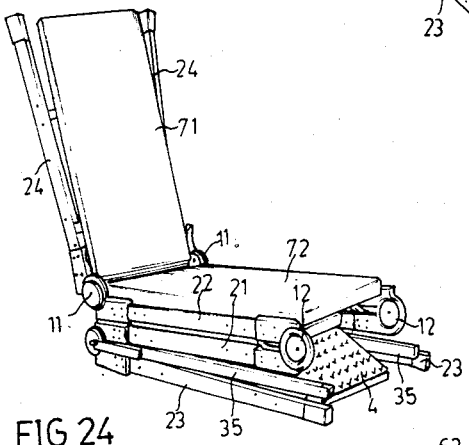
FIG. 24 is a view showing the ladder converted into a sitting chair.
Figure 25:
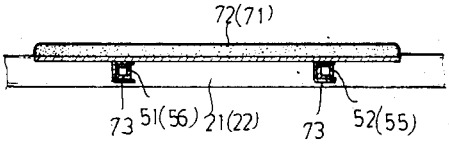
FIG. 25 is an enlarged view showing the way in which the sitting pad is mounted on the rungs of the ladder with its U-shaped hooks.

With the ladder converted into the exercise apparatus as shown in FIG. 22, the user can do sit-up exercise in a standard position for strengthening muscles of his belly thereon. When the ladder is set in the form as shown in FIG. 23, the user can do waist-twisting exercise thereon with both feet disposed under said bar member 63 for holding purpose. Furthermore, the ladder can be put into different forms, permitting people to enjoy a plurality of physical exercises, such as the apparatus illustrated in FIGS. 24, 26. A pair of sitting pads 71, 72, having a pair of U-shaped hooks 73 disposed thereunder for fixing purpose as shown in FIG. 25; moreover, rungs 53, 54 and said horizontal bar member 62 are all equipped with soft covers 531, 541, 621 for better exercise condition.

Figure 28:
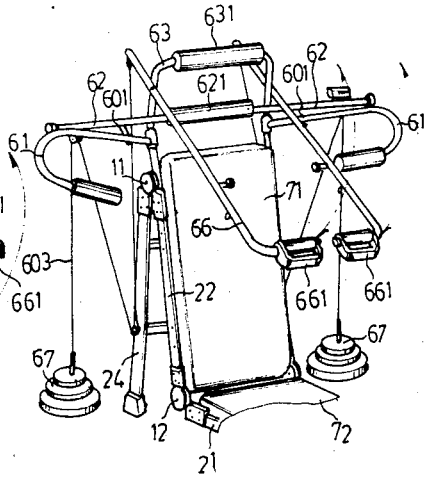
FIG. 28 is a view showing the exercise chair in FIG. 27 being operated in the direction indicated by arrows.
Figure 26:
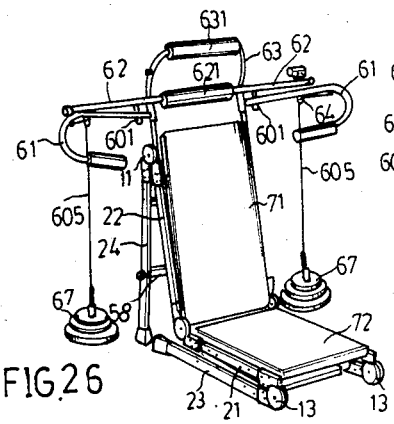
FIG. 26 is a view showing the ladder transformed into an exercise chair particularly for chest-expanding exercise.
Figure 27:
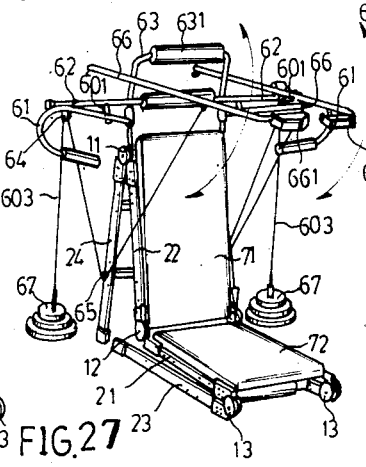
FIG. 27 is a view showing the ladder transformed into an exercise chair particularly for arm-strengthening exercise.

After the above detailed description, it becomes clear that the folding ladder can be transformed into a variety of exercise apparatuses, allowing people to do almost every well-known exercise, ranging from sit-up, chest-expansion as shown in FIG. 26, muscle-building, wrist-strengthening, leg-strengthening, weight-lifting as shown in FIG. 27, arm and leg-stretching as shown in FIG. 28 and etc..

To sum up, the present invention is intended to provide a foldable ladder equipped with detachable supporting handrails as well as a stand-on board when set up for use as a stepladder, and collectedly folded into a compact form when not used. In consideration of safety and convenience, the supporting handrails and stand-on board are designed to be readily assembled or disassembled and folded with ease so that it will not hinder the normal operation of the ladder at all when mounted thereon; moreover, the stepladder can not only be converted into a number of ladders of various forms but also into tables, easels, chairs and especially into multiplex exercise apparatuses for enabling users to do almost all kinds of physical exercises thereon with the help of some simple accessory parts such as counterweight, cables and pulleys and bar members mounted thereon so that it can be readily used in multiplex form.

The most important characteristics of the present invention is the detachable mount of said supporting handrails and said stand-on board on the ladder so to illiminate the disadvantages of a conventional stepladder, allowing the user to stand on the stepladder for working longer and in a safer condition, and the multiplex functions of the foldable ladder improve the practicality of the ladder greatly.

What I claim is:

1. A multi-purpose aluminum folding ladder detachably equipped with supporting handrails as well as a stand-on board, comprising 3 paired fixing knuckles, 4 paired ladder upright bar members and a plurality of rungs, and each said supporting handrail consisting of 4 hollow bar members and 1 grip bar wherein one of said pivotably-connected bar members is removably bolted to one of said fixing knuckles with the other bar members extendably received in each other consecutively, and between the two parallel bottommost bar members of said supporting handrails disposed a transverse rung on which said stand-on board can partially be supported, on the bottom of said stand-on board disposed a number of U-shaped hook elements which are employed to engage said stand-on board with said rungs of the ladder so to firmly fixed said stand-on board thereon, and said board being readily foldable and attached to the bottom of said ladder with the top side of said folded board lower than the bottommost rung so not to hinder normal operation of said ladder.

2. A multi-purpose aluminum folding ladder according to claim 1 wherein said supporting handrail having 5 tubular members is comprised of a rod, 2 holding sticks, a grip bar, a bottom stick, said rod is extendably accommodated in one of said holding stick and is threaded at one end for screwingly connected to an inner threaded tube of a fixing knuckle, and the first holding stick and the grip bar pivotably joined together to the second holding stick and foldably received therein, and said second holding stick being pivotably connected to said bottom stick and foldably received in the U-shaped hollow interior of said bottom stick which is bolted to one of said fixing knuckle.

3. A multi-purpose aluminum folding ladder according to claim 1 wherein said supporting handrail can be comprised of four tubular bar members of different sizes so that said handrail can be collected with the smaller tubular bar members consecutively received in the larger members to reduce the size of said folded handrail, and can be extendably pulled out consecutively and fixed in position with one end thereof bolted to one fixing knuckle and the other end coupled to a threaded hole.

4. A multi-purpose aluminum folding ladder according to claim 1 wherein exercise accessory parts are removably mounted thereon so to transform said ladder into different exercise apparatuses, said accessory parts inclnding 2 sitting pads, a C-shaped top bar member with its two ends inserted in the tubular portions of a pair of said fixing knuckles, and an extended horizontal bar member having two pulleys disposed at the ends thereof respectively through which cables having adjustable counter weights attached at one end thereof are led via a pair of pulley attached at the sides of the upright bar members of said ladder and coupled to a pair of oar bar members attached to the sides of the upright bar members of the ladder so to enable people to engage in rowing exercises thereon.

5. A multi-purpose aluminum folding ladder according to claim 4 wherein the symmetric frame consists of an extended horizontal bar member, a pair of chest-expanding bar members and a C-shaped top bar member, said paired chest-expanding bar members being pivotably coupled to said C-shaped top bar member and connected by cables to the counter weights through hanged hooks located at the ends of said chest-expanding bar members so that people can exercise their muscles by lifting and lowering said chest-expanding bar members.

6. A multi-purpose aluminum folding ladder according to claim 4 wherein a pulley can be removably fixed on the bottom rung of said ladder, through which a cable is led, said calbe being then coupled to two splited cables at one end which are joined to couter weights respectively, permitting people to do exercises of strengthening arms or legs by way of operating on a grip bar disposed at the other end of said cable.

* * * * *